United States Patent [19]

Mishler et al.

[11] Patent Number: 4,679,017

[45] Date of Patent: Jul. 7, 1987

[54] EMERGENCY MANUAL ACTUATION MECHANISM FOR A SOLENOID

[75] Inventors: Ralph E. Mishler, Deerfield; Peter J. Stocco, Lombard, both of Ill.

[73] Assignee: Synchro-Start Products, Inc., Skokie, Ill.

[21] Appl. No.: 841,166

[22] Filed: Mar. 19, 1986

[51] Int. Cl.[4] ..... H01H 9/20

[52] U.S. Cl. ..... 335/164; 335/255; 335/263; 251/129.03

[58] Field of Search ..... 335/164, 171, 256, 255, 335/263; 251/129.03

[56] References Cited

U.S. PATENT DOCUMENTS

| | | | |
|---|---|---|---|
| 1,786,234 | 12/1930 | Forman . | |
| 2,051,938 | 8/1936 | Carlson . | |
| 2,354,704 | 8/1944 | Ray . | |
| 2,415,739 | 2/1947 | Fuchs | 335/263 |
| 2,675,508 | 4/1954 | Ray . | |
| 2,756,370 | 7/1956 | Meusy . | |
| 3,231,790 | 1/1966 | Vander Kaay . | |
| 3,254,660 | 6/1966 | Ray . | |
| 4,494,096 | 1/1985 | Fuzzell . | |

FOREIGN PATENT DOCUMENTS

| | | | |
|---|---|---|---|
| 2645887 | 4/1978 | Fed. Rep. of Germany | 251/129.03 |

*Primary Examiner*—E. A. Goldberg
*Assistant Examiner*—Lincoln Donovan
*Attorney, Agent, or Firm*—Kinzer, Plyer, Dorn & McEachran

[57] ABSTRACT

An emergency manual actuation mechanism for a conventional solenoid having a plunger with one end connected to an external apparatus, such as a diesel engine fuel pump, in which energization of the solenoid coil retracts the plunger axially; the mechanism comprises a non-magnetic retraction rod that extends into the solenoid housing in alignment with the solenoid plunger and is axially movable from a normal position disengaged from the plunger to an intermediate position at which a mechanical connection is completed between the rod and the plunger. Further axial or rotary movement of the retraction rod to a retraction position drives the plunger to its retracted position, simulating energization of the solenoid coil. Retainer means hold the retraction rod and the solenoid plunger at their retracted positions.

37 Claims, 15 Drawing Figures

Fig. 13.
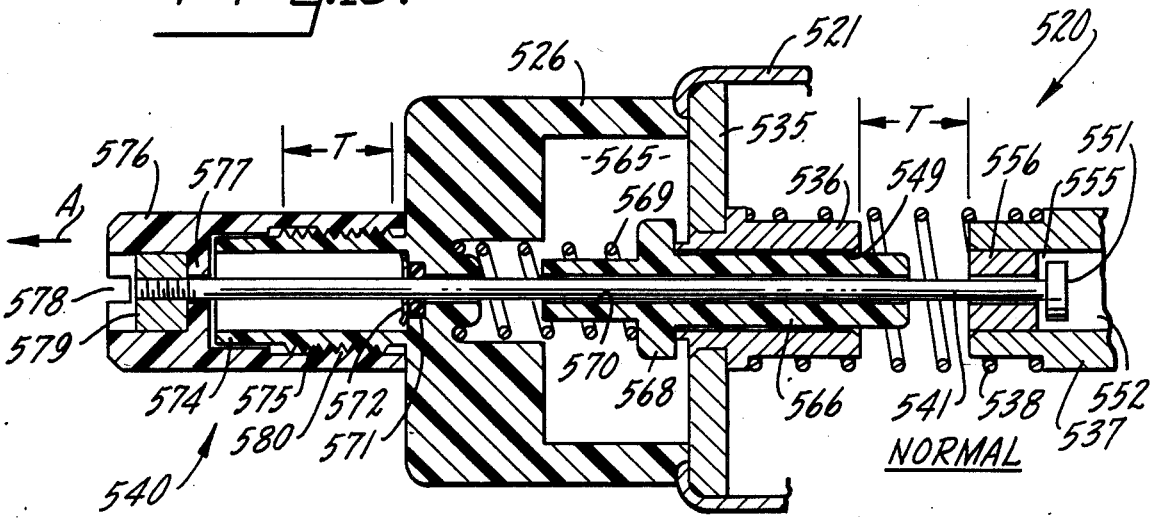
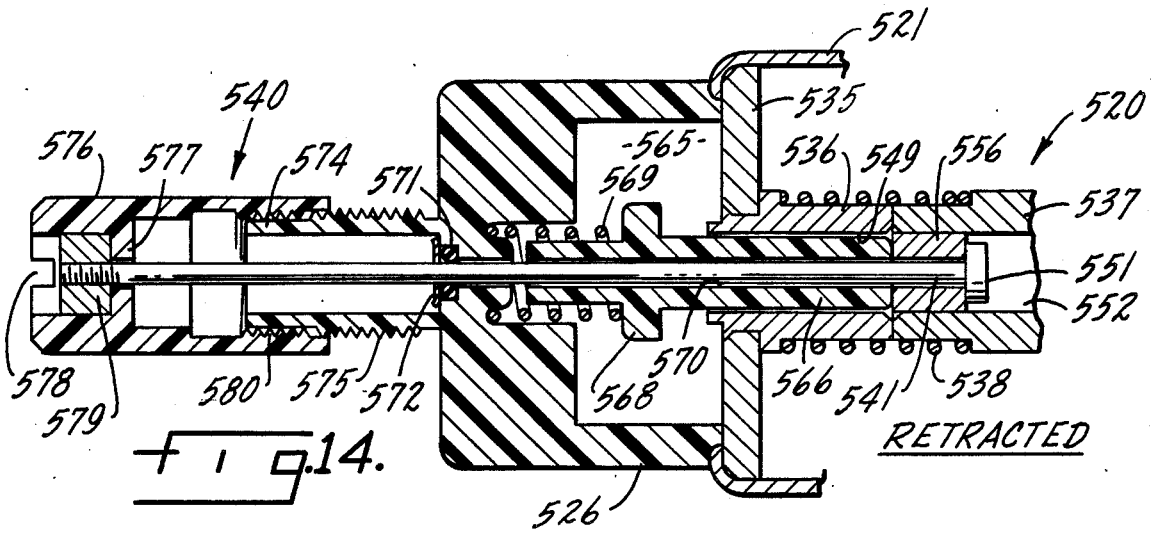
Fig. 14.

EMERGENCY MANUAL ACTUATION MECHANISM FOR A SOLENOID

BACKGROUND OF THE INVENTION

One customary application for a solenoid is in the control of the fuel supply to a diesel engine, as in a diesel powered truck, automobile, or other vehicle. The solenoid plunger is connected to the fuel pump for the engine in an arrangement such that the solenoid plunger has its maximum extension when the solenoid is in its initial de-energized condition. For this operating condition, the fuel supply to the diesel engine is cut off and the engine cannot run. Whenever the engine is to be started, the solenoid is energized to retract its plunger, which conditions the fuel pump to supply fuel to the engine. Usually, a dual coil solenoid is employed, incorporating a pulling coil and a holding coil. The coils are energized to pull the solenoid plunger to a retracted position. When the movement of the plunger to its retraction position is completed, the pulling coil is de-energized but the holding coil remains energized to keep the plunger retracted. When it is desired to shut off the engine the holding coil is de-energized to allow a return spring for the solenoid to restore the plunger to its original intended position. Similar solenoid uses occur with stationary engines and in other applications.

In an arrangement of this kind, if there is an electrical failure in the solenoid or in the circuits connected to the solenoid, it may be impossible to energize the solenoid coils, particularly the pulling coil, to retract the plunger and allow operation of the engine. In these circumstances, with most solenoids it is essentially impossible to retract the solenoid plunger to allow operation of the engine long enough to get the truck or other vehicle to a location where repair can be conveniently effected. Usually, it is necessary to tow the vehicle to a repair facility. In industrial applications, a similar electrical failure may cause a costly interruption in a critical industrial process.

SUMMARY OF THE INVENTION

It is a primary object of the invention to provide a new and improved emergency manual actuation mechanism for a solenoid that makes it possible to simulate the usual solenoid operation by moving the solenoid plunger from its initial position to its retraction position and retaining the plunger retracted despite an electrical failure in the solenoid or in its external energizing circuits.

Another object of the invention is to provide a new and improved emergency manual actuation mechanism for a solenoid that is simple and economical in construction, reliable in operation, and requires no special tools for operation.

Accordingly, the invention relates to an emergency manual actuation mechanism for a solenoid of the kind comprising an elongated housing, a magnetic plunger disposed within the housing and axially movable between an initial position and an actuation position, one end of the plunger being accessible through one end of the housing for connection to an external apparatus, spring means biasing the plunger toward its initial position, and solenoid coil means for driving the plunger to its retraction position. The emergency manual actuation mechanism comprises a retraction rod axially movably mounted in the other end of the solenoid housing in alignment with the plunger, the retraction rod having a normal position in which the retraction rod is effectively disengaged from the plunger and does not interfere with or react to plunger movement. Connecting means are provided for interconnecting the retraction rod and the solenoid plunger together with means for moving the retraction rod from its normal position to a retraction position through an intermediate position, such movement of the retraction rod to its intermediate position engaging the connecting means and such further movement of the retraction rod to its retraction position driving the plunger from its initial position to its actuation position. Retainer means are included for retaining the retraction rod and the plunger in their respective retraction positions.

BRIEF DESCRIPTION OF THE DRAWINGS

FIGS. 13 and 14 are simplified sectional views of another embodiment of the invention in its normal, unactuated condition (FIG. 13) and in its actuated, retracted condition (FIG. 14).

DESCRIPTION OF THE PREFERRED EMBODIMENTS

Figure 1:
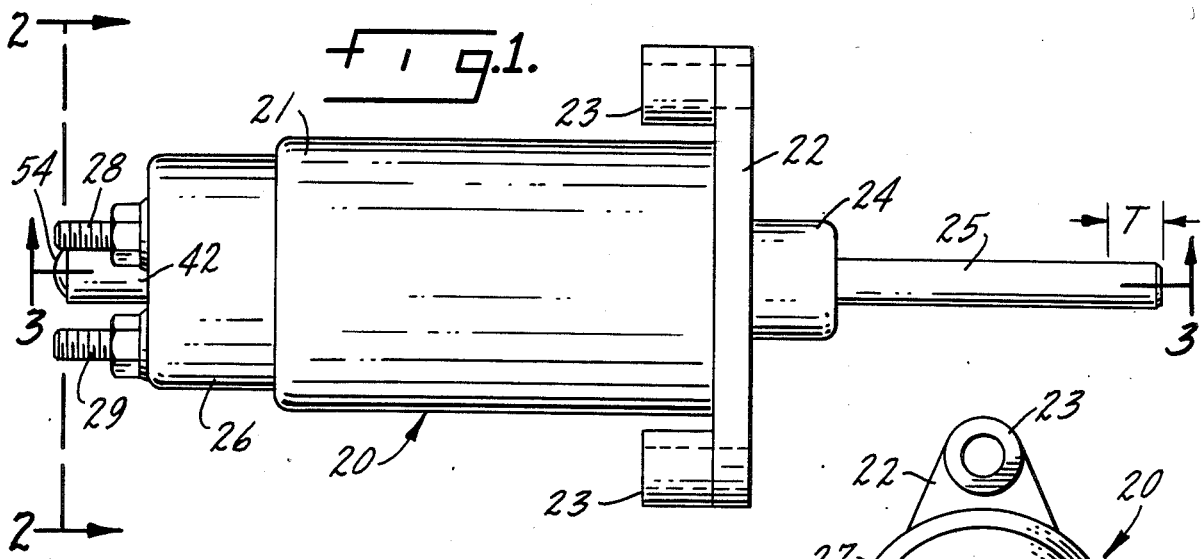
FIG. 1 is a side elevation view of a solenoid incorporating an emergency manual actuation mechanism in accordance with one embodiment of the invention.
Figure 2:
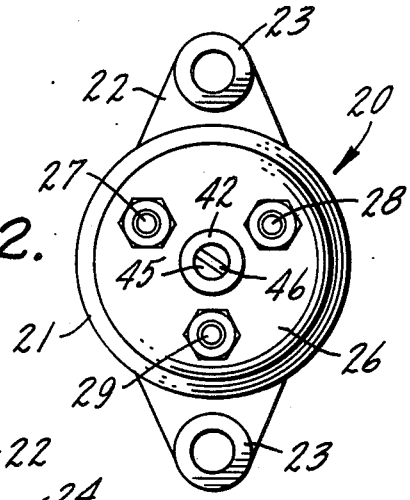
FIG. 2 is an end view of the solenoid taken approximately as indicated by line 2—2 in FIG. 1.
Figure 3:
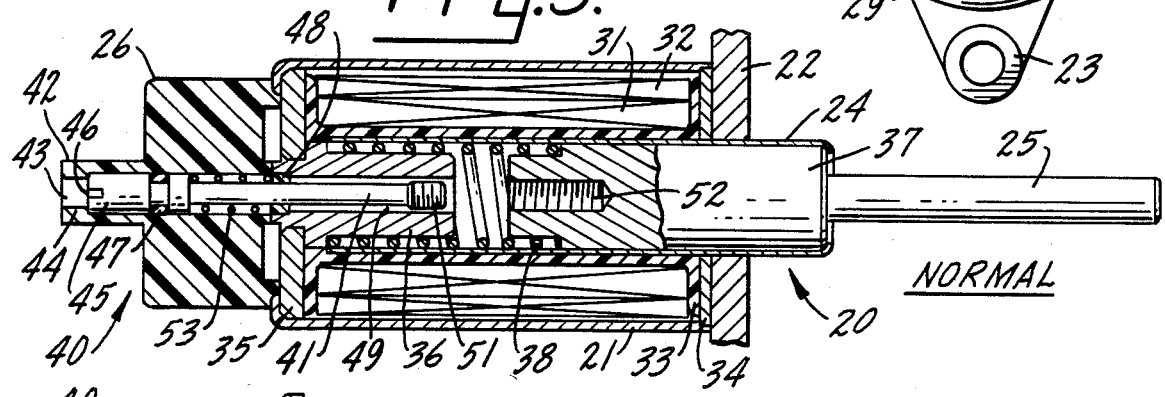
FIG. 3 is a sectional view taken approximately as indicated by line 3—3 in FIG. 1, showing the solenoid in its de-energized initial operating condition and the manual actuation mechanism in its normal, unactuated condition.

FIGS. 1-3 illustrate a solenoid 20 comprising a cylindrical main housing 21 of magnetic steel tubing affixed at one end to a mounting flange plate 22. Two bushings 23 are mounted on flange plate 22 to afford a convenient means for mounting the solenoid on an external support (not shown). A plunger rod 25 projects outwardly through one end of a non-magnetic (brass liner) 24 that extends beyond plate 22 at one end of the solenoid housing. Rod 25 is utilized to connect solenoid 20 to an external mechanism (not shown) such as the fuel pump of a diesel engine in a truck, automobile, or other vehicle.

At the end of solenoid 20 opposite flange plate 22 and plunger rod 25, solenoid 20 is provided with a molded resin terminal housing 26. Housing 26 may be utilized as the housing for a switch for the electrical operating coils of the solenoid; in solenoid 20, however there is no switch incorporated in end cover 26. Three electrical connection posts 27, 28 and 29 project outwardly from the solenoid terminal housing 26. Posts 27 and 28 are utilized, in the illustrated switchless solenoid 20, to afford electrical connections to each of two electrical coils, a pulling coil 31 and a holding coil 32, within the solenoid; see FIG. 3. Post 29 affords a common ground connection for the two solenoid coils 31, 32. Coils 31 and 32 are mounted on a coil support or bobbin 33 disposed in encompassing relation to the brass liner 24 inside housing 21.

Starting at the front end of solenoid 20 adjacent plate 22, the right hand end of the solenoid as shown in FIG. 3, the magnetic circuit for the solenoid comprises a front end plate 34, flange 22, housing 21, a rear end plate or attraction plate 35, and an attraction stud 36 that projects into the brass liner 24 at the other end of the solenoid. The magnetic main solenoid plunger 37, on which plunger rod 25 is mounted, is disposed within brass liner 24 and is biased to the position illustrated in FIG. 3 by a return spring 38.

As thus far described, solenoid 20, FIGS. 1–3, is conventional in construction. In a vehicle application, as discussed above, rod 25 of solenoid 20 may be connected to the fuel pump of a diesel engine. When the solenoid is in the deenergized condition shown in FIGS. 1 and 3, with its plunger rod 25 fully extended, the fuel pump is shut off. To permit the fuel pump to operate so that the engine can run, coils 31 and 32 are electrically energized through the external connection posts 27–29. The magnetic flux generated by the coils in the magnetic circuit of solenoid 20, described above, drives plunger body 37 and rod 25 toward attraction stud 36, overcoming the bias afforded by return spring 38. When the inner end of plunger 37 contacts attraction stud 36, the total travel for plunger 37 and its connecting rod 25 is complete and the plunger is in its actuation position. This travel distance T (FIGS. 1 and 4) may vary substantially, depending upon the requirements of the equipment with which solenoid 20 is used. When the solenoid plunger has completed its full retraction travel T, the main pulling coil 31 may be deenergized because a substantially reduced magnetic force is adequate to hold the plunger in its actuation position against attraction stud 36.

The emergency manual actuation mechanism 40 of the present invention, shown in its normal, unactuated condition in FIG. 3, comprises a retraction rod 41 that is axially movably mounted in the rear end of solenoid 20, the end opposite plunger connection rod 25. The outer end of rod 41 is disposed within a tubular guide 42 that is formed integrally with and projects outwardly from terminal housing 26 and that is aligned with the axis of the solenoid. The outer end of guide 42 has an access opening 43 terminating at an internal shoulder 44. Shoulder 44 affords a stop for a head 45 mounted on retraction rod 41. Head 45 has an end slot 46 engageable by a conventional screwdriver; alternatively, head 45 may be provided with a hexagonal socket or other configuration for reception of another type of conventional manual driving tool. Head 45 is also provided with an annular peripheral slot in which an O-ring seal 47 is mounted. A dust cap 54 may be mounted in the access opening 43.

An annular bushing 48 is disposed in encompassing relation to the central portion of retraction rod 41; bushing 48 is seated against the outer end of attraction stud 36. Bushing 48 is preferably a split ring bushing of molded glass reinforced nylon or other resin capable of withstanding high temperatures, and is utilized for accurately centering retraction rod 41 in a central axial bore 49 in attraction stud 36. The inner end 51 of retraction rod 41 is slightly enlarged and is threaded to afford a part of a connecting means for interconnecting the retraction rod and solenoid plunger 37. Plunger 37 is provided with an internally threaded axial socket 52 aligned with the threaded end section 51 of retraction rod 41.

As long as solenoid 20 functions normally, there is no need for the emergency manual actuation mechanism 40. Whenever it is necessary or desirable to have the solenoid plunger 37 and its connection rod 25 moved from the initial position shown in FIG. 3 to the actuation position for the plunger, this is accomplished by electrical energization of coils 31 and 32 as described above. Plunger 37 is held in retracted position by maintaining energization of holding coil 32. To return the solenoid to its initial operating condition, with plunger 37 and rod 25 fully extended, it is only necessary to deenergize holding coil 32. If there is an electrical failure in the solenoid or in its external electrical circuits, however, this normal mode of operation cannot be employed. In these circumstances, if it is necessary or desirable to actuate solenoid 20 to retract plunger 37 and connecting rod 25, mechanism 40 is utilized.

Figure 4:
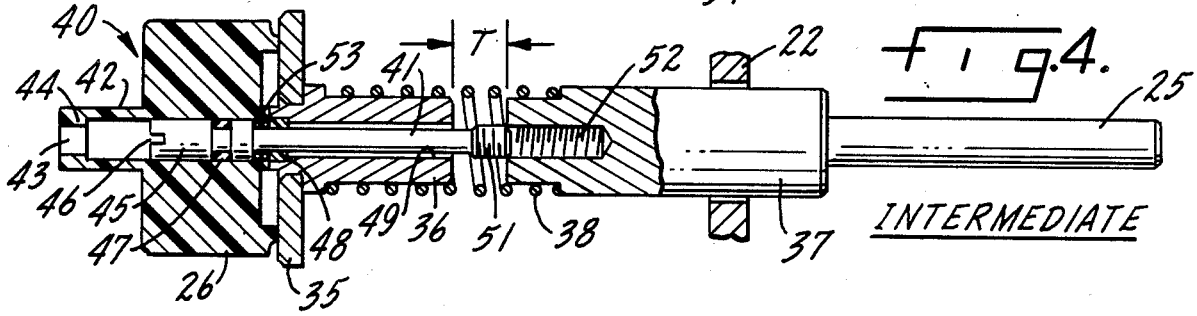
FIG. 4 is a simplified view similar to FIG. 3 but showing the manual actuation mechanism in an intermediate operating condition.

To operate the emergency manual actuation mechanism 40, dust cap 54 is removed and a screwdriver is inserted through opening 43 in the outer end 44 of guide sleeve 42, engaging slot 46 in the retraction rod head 45. By pushing inwardly on the screwdriver, rod 41 is driven toward plunger 37 to an intermediate position in which the threaded end portion 51 engages the threads at the inner end of socket 52. This engagement is readily ascertained by the user of the screwdriver. At this point, the screwdriver is used to rotate retraction rod 41, threading the end section 51 of the retraction rod into socket 52. This intermediate stage of operation of mechanism 40 is illustrated in FIG. 4.

Figure 5:
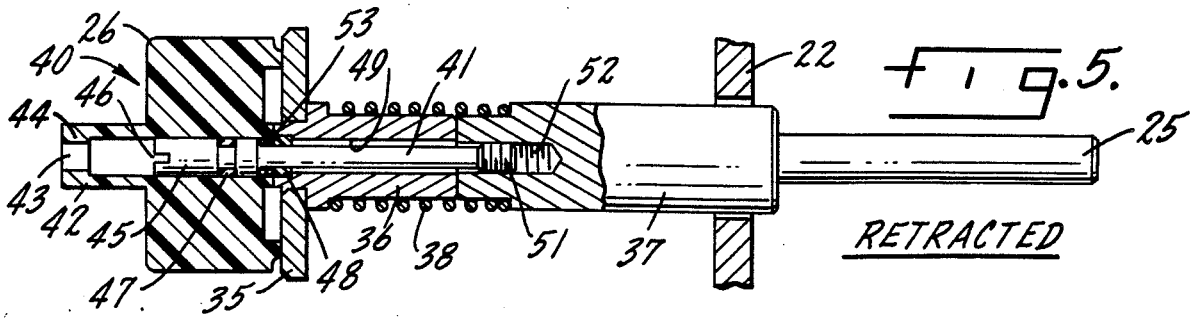
FIG. 5 is a view corresponding to FIG. 4 but illustrating the manual actuation mechanism in its retracted, actuated condition.

With continued rotation of retraction rod 41, using the screwdriver or other manual driver tool engaged in slot 46, plunger 37 is pulled toward attraction stud 36. Spring 38 prevents plunger 37 from rotating. Rotation of the retraction rod is continued until plunger 37 is pulled into engagement with attraction stud 36 as shown in FIG. 5. This is the same operating position for plunger 37 as is normally achieved through the use of coils 31 and 32 in ordinary electrical operation of solenoid 20. Thus, for a solenoid utilized in the engine of a truck or other vehicle, the fuel pump may be actuated and the engine may be started to enable the vehicle to "limp" home. In the retracted position of FIG. 5 the mating threaded elements 51 and 52 also serve as a retainer means, retaining both retraction rod 41, and plunger 37 in their respective retraction and actuation positions. When the need for emergency actuation no longer exists, a screwdriver may again be inserted through aperture 43 into engagement with slot 46 to rotate retraction rod 41 until threads 51 and 52 are disengaged, allowing the emergency actuation mechanism 40 to return to the initial operating condition shown in FIG. 3.

As shown in FIG. 3, the threaded outer end 51 of retraction rod 41 is recessed within the inner end of the central bore 49 in attraction stud 36 when the emergency manual actuation mechanism 40 is in its normal unactuated condition. This is done to preclude damage to the threads on end 51 of retraction rod 41 during normal operation of solenoid 20. A bias spring 53 may be provided for retraction rod 41 if desired. However, due to the anticipated limited use of mechanism 40, in most instances no return spring is required.

Seal 47 serves two purposes. In engine applications where the solenoid plunger 37, 25 is exposed to low pressure in the engine crankcase, the seal precludes engine lubricating oil leakage from the solenoid through its terminal housing 26. In addition, regardless of whether the solenoid is exposed to lubricating oil in an engine application, seal 47 serves to damp any axial motion of retraction rod 41 that might be occasioned by vibration, retaining the retraction rod within the confines of attraction stud 36 as illustrated.

Retraction rod 41 should be made of a non-magnetic material. A high temperature molded resin material, capable of withstanding the heat loading generated by the pulling coil 31 of solenoid 20, is preferred. Retraction rod 41 may be molded from the same material as bushing 48 and dust cap 54; all three can be molded in a family mold and bushing 48 may be assembled on rod 41 as they are ejected from the mold. Glass filled nylon is a preferred material for rod 41 and bushing 48.

Figure 6:
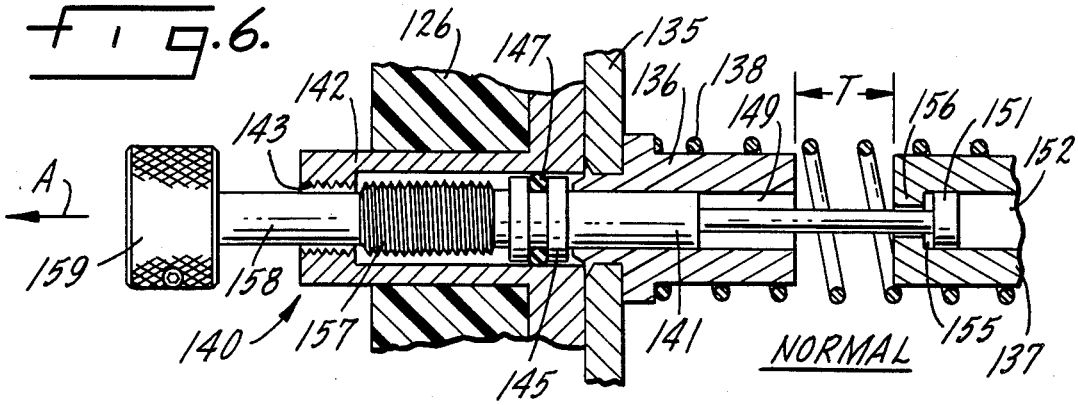
FIG. 6 is a simplified sectional view of another embodiment of the emergency manual actuation mechanism in its normal, unactuated condition.
Figure 7:
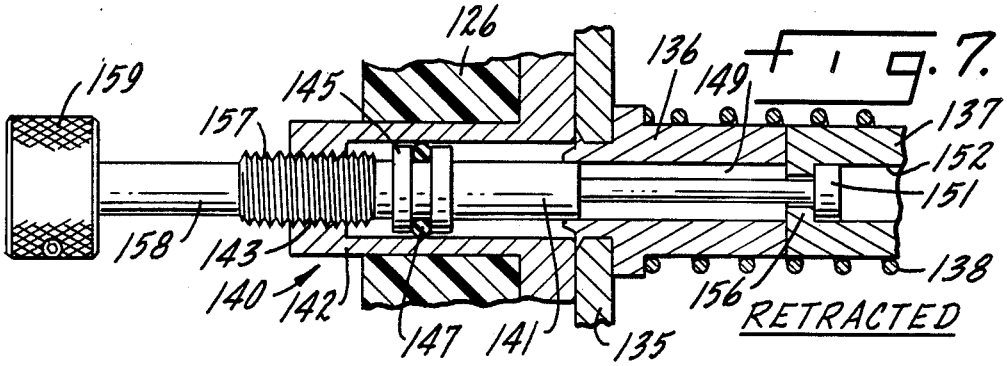
FIG. 7 is a view corresponding to FIG. 6 but showing the manual actuation mechanism in its retracted, actuated condition.

FIGS. 6 and 7 illustrate an emergency manual actuation mechanism 140 for a solenoid that comprises another embodiment of the invention. In these figures, the components of the solenoid that do not enter into operation of the emergency mechanism have been omitted. Thus, the only portions of the solenoid that appear in FIGS. 6 and 7 are the terminal housing 126, the attraction end plate 135 and attraction stud 136, the end of the plunger body 137 adjacent the attraction stud, and the plunger return spring 138. In FIG. 6 the solenoid mechanism is shown in its normal, unactuated condition with plunger 137 in its initial position, whereas in FIG. 7 the plunger is in its retracted actuation position. As before, the travel for solenoid plunger 137 is indicated by the distance T, FIG. 6.

The emergency manual actuation mechanism 140 of FIGS. 6 and 7 comprises an elongated non-magnetic retraction rod 141 that extends through a guide sleeve 142 aligned with the solenoid axis. The outer end of guide sleeve 142 comprises a threaded bore 143. The central portion of rod 141 includes an enlarged section 145 having an annular slot in which an O-ring seal 147 is mounted. The inner end of rod 141 projects through an axial bore 149 in attraction stud 136 and terminates with an enlarged head or shoulder 151 located within a socket or bore 152 in the solenoid plunger 137. Plunger 137 has a shoulder 156 in the outer end of socket 152 positioned for engagement by shoulder 151 on rod 141. Shoulder 156 may be formed by a separate bushing.

The outer end of retraction rod 141, to the left of the enlarged seal section 145, includes an elongated threaded section 157 and an extension portion 158. The rod extension 158 projects outwardly through the threaded bore 143 in sleeve 142. A knob 159 is affixed to the outer end of extension portion 158 of retraction rod 141. In the normal position shown in FIG. 6, the threaded section 157 of the retraction rod is located closely adjacent to but is not engaged with the threads in sleeve bore 143.

To actuate the emergency mechanism 140 from the normal condition of FIG. 6 to the retracted condition of FIG. 7, knob 159 is first used to pull retraction rod 141 outwardly in the direction of arrow A through a distance sufficient to engage the threaded section 157 of the retraction rod with the threads 143 of guide sleeve 142. This does not require the operator to move the solenoid plunger 137 against the strong bias of its return spring 138, due to a small clearance 155 between the retraction rod shoulder 151 and plunger shoulder 156, FIG. 6. Once the threads are engaged, knob 159 is rotated to pull retraction rod 141 and solenoid plunger 137 to their respective retraction and actuation position shown in FIG. 7. The thread connection 143, 157 affords a substantial mechanical advantage to assist in overcoming the biasing force exerted by the return spring for the solenoid plunger. Knob 159 may be made with an appropriate configuration for engagement by a wrench or screwdriver for additional mechanical advantage.

With mechanism 140 in its retracted condition, FIG. 7, threads 143 and 157 serve an additional purpose, retaining rod 141 in its retraction position. To return the mechanism to the normal condition shown in FIG. 6, it is only necessary to rotate knob 159 and rod 141 to disengage the threads; return spring 138 returns both the solenoid and the emergency mechanism 140 to their initial conditions. If more positive assurance of retention of rod 141 in its retraction position is desired, a cotter key through the outer end of sleeve 142 and through extension 158 of rod 141 (not shown) may be utilized.

Figure 8:
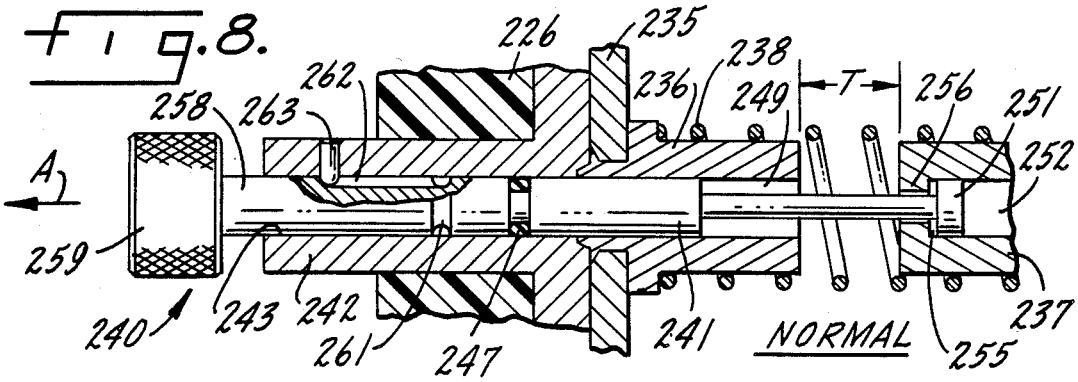
FIGS. 8 and 9 are simplified sectional views illustrating another embodiment of the emergency manual actuation mechanism in its normal, unactuated condition (FIG. 8) and its retracted, actuated condition (FIG. 9)
Figure 9:
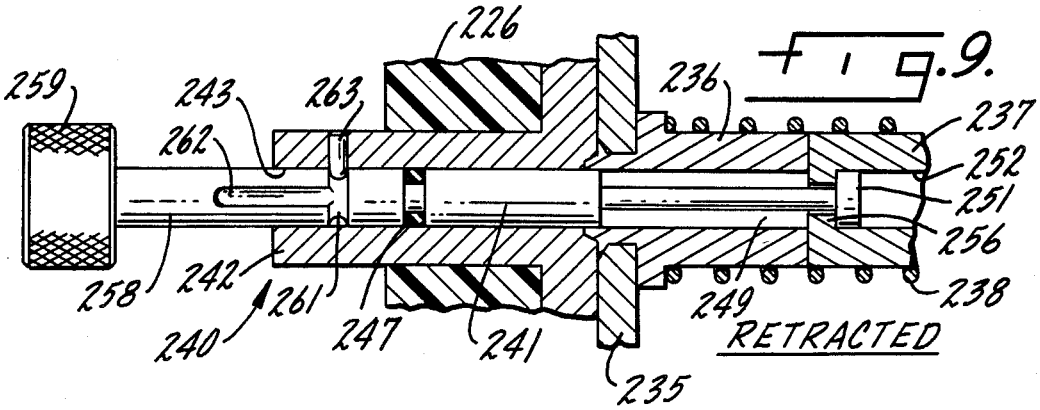

FIGS. 8 and 9 illustrate a further embodiment of the invention constituting a mechanism 240 for emergency manual actuation of a solenoid. As in FIGS. 6 and 7, only a limited portion of the solenoid has been shown, comprising the terminal housing 226, the rear end attraction plate 235, the attraction stud 236, the plunger body 237, and a solenoid return spring 238. FIG. 8 shows mechanism 240 in its normal, unactuated condition, whereas FIG. 9 shows mechanism 240 in its actuated position, simulating the energized retraction position for the solenoid. The travel for plunger 237 between these two positions is the distance T, FIG. 8.

The emergency manual actuation mechanism 240 of FIGS. 8 and 9 comprises an elongated non-magnetic retraction rod 241 extending through the central bore 243 in a guide sleeve 242 aligned along the solenoid axis. An annular recess in rod 241 accommodates an O-ring seal 247 that engages the inner wall of bore 243 in the guide sleeve. Retraction rod 241 also extends through a central bore 249 in attraction stud 236. The inner end of the retraction rod terminates with a shoulder 251 disposed within an axial socket 252 in the solenoid plunger 237. The retraction rod shoulder 251 is engageable with a shoulder 256 at the outer end of plunger socket 252; however, there is normally a small clearance 255 between shoulders 251 and 256 when mechanism 240 is in the normal position of FIG. 8.

A knob 259 is mounted on the outer end 258 of retraction rod 241, which projects beyond sleeve 242 of housing 226. Within the confines of bore 243 in guide sleeve 242 there is an annular groove 261 in the periphery of retraction rod 241. Groove 261 connects with an elongated slot 262 extending along the outer surface of rod 241. In the normal position of FIG. 8, a pin 263 mounted in sleeve 242 and projecting inwardly of sleeve 242 into bore 243 engages in the outer end of channel 262.

To actuate mechanism 240 from the normal position of FIG. 8 to the retraction position illustrated in FIG. 9, knob 259 is grasped and pulled outwardly in the direction of arrow A. The resulting movement of retraction rod 241 pulls solenoid plunger 237, against the bias of spring 238, until the plunger engages retraction stud 236 in the position shown in FIG. 9. This movement brings the annular groove 261 in retraction rod 241 into alignment with pin 263. Knob 259 is then rotated to rotate retraction rod 241 so that pin 263 is no longer aligned with channel 262. This leaves the mechanism in the full retraction position shown in FIG. 9, with the engagement of pin 263 in groove 261 serving as a retainer means to maintain the solenoid in its retraction condition.

To return mechanism 240 to the normal operating condition of FIG. 8 from the retraction condition illustrated in FIG. 9, it is a simple matter to rotate retraction rod 241, by means of knob 259, to re-align pin 263 with channel 262. When this is done, the return spring 238 of the solenoid drives the mechanism back to the normal position of FIG. 8, in which mechanism 240 does not interfere with conventional operation of the solenoid.

Figure 10:
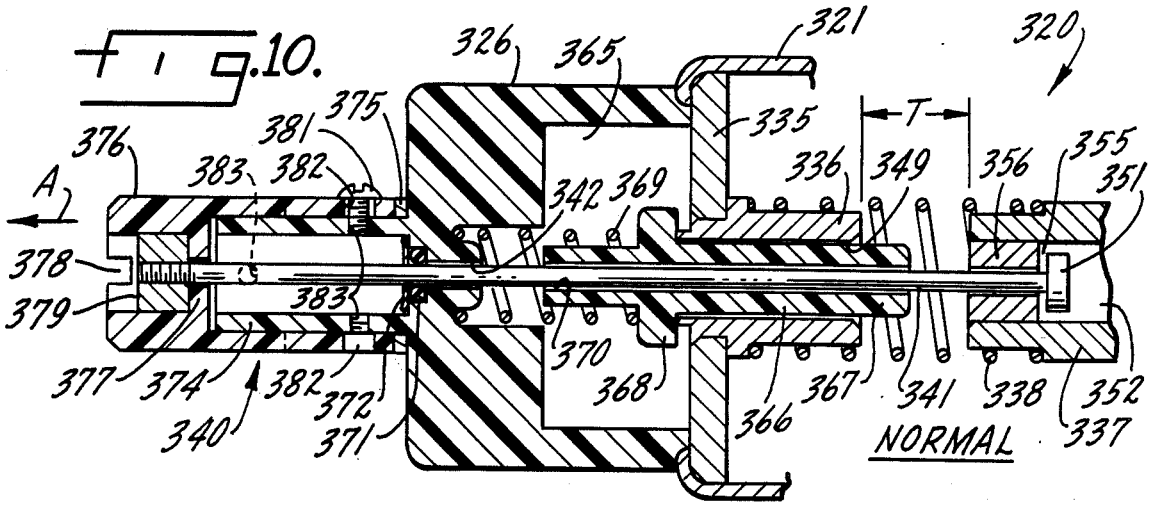
FIGS. 10 and 11 are simplified sectional elevation views of a further embodiment of the emergency manual actuation mechanism in its normal, unactuated condition (FIG. 10) and its retracted, actuated position (FIG. 11)
Figure 11:
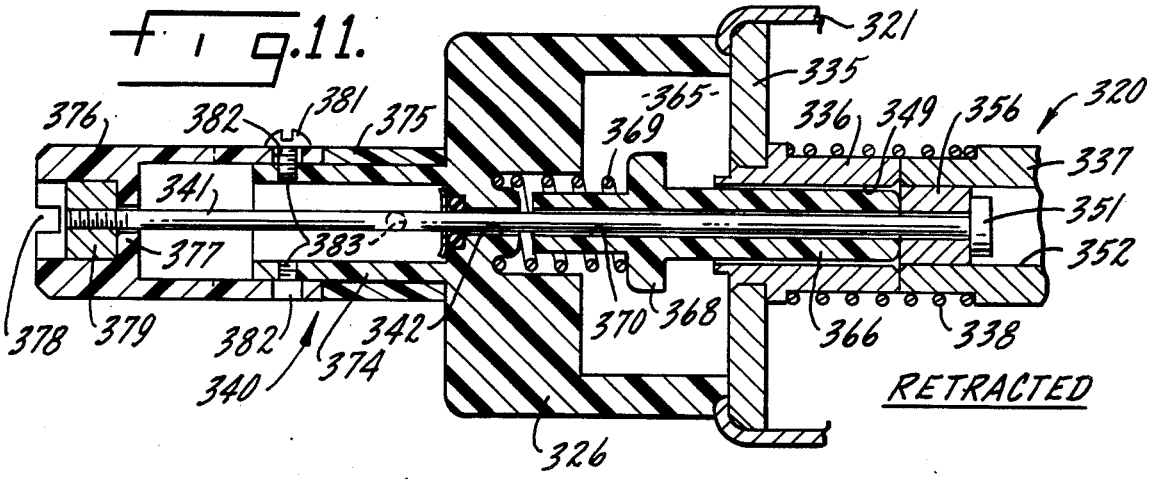
Figure 12:
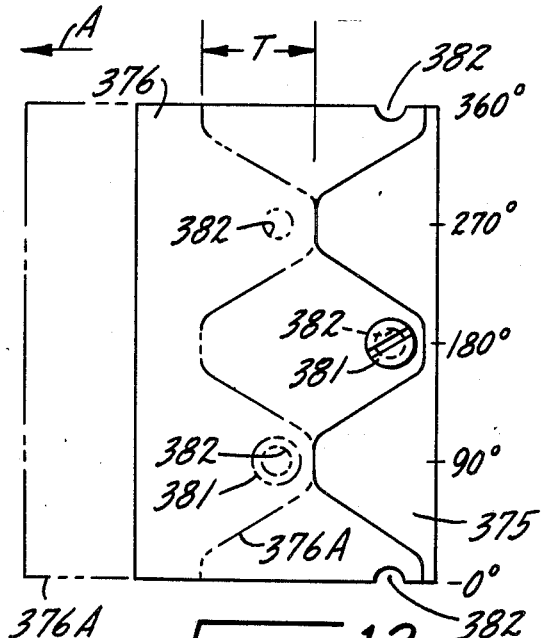
FIG. 12 is a diagrammatic displacement view of cam elements of the mechanism of FIGS. 10 and 11.

FIGS. 10–12 illustrate a further embodiment of the invention constituting an emergency manual actuation mechanism 340 as applied to a solenoid 320 of the kind that incorporates a switching mechanism for the pulling and holding coils of the solenoid. FIGS. 10 and 11, like FIGS. 6–9, show only a part of the solenoid itself. The illustrated portions of solenoid 320 include the main housing 321, a switch housing 326 at the rear of the solenoid, the rear end plate 335 and attraction stud 336 for the solenoid magnetic circuit, the main plunger body 337, and the plunger return spring 338. With the exception of switch housing 326, these components serve the same purposes and function in the same manner as described for the switchless solenoid 20 illustrated in FIGS. 1 and 3.

Switch housing 326 of solenoid 320, as illustrated in FIGS. 10 and 11, is again preferably formed of molded resin material. The configuration of switch housing 326 is such as to provide a substantial internal chamber 365 in which a conventional switching mechanism (not shown) is mounted. The switch mechanism is of the kind actuated by a switch actuation plunger 366 which projects outwardly from chamber 365 through the central bore 349 in attraction stud 336. The inner end 367 of plunger 366, facing the main solenoid plunger 337, extends an appreciable distance beyond the inner end of attraction stud 336 when the solenoid 320 is de-energized. Within chamber 365, the switch actuation plunger 366 incorporates an integral shoulder 368 that is utilized to actuate the switching mechanism. A return spring 369 is provided for plunger 366.

In the normal electrical operation of solenoid 320, starting from the normal condition illustrated in FIG. 10, the pulling and holding coils of the solenoid 320 (see coils 31, 32, FIG. 3) are both energized. As a consequence, plunger 337 is driven toward attraction stud 336, compressing return spring 338. Continued movement of plunger 337 brings it into contact with the switch actuation plunger 366 and drives the switch actuation plunger through chamber 365 in switch housing 326. The end position is as shown in FIG. 11 with solenoid plunger 337 in contact with attraction stud 336. During this movement, shoulder 368 on the switch actuation plunger 366 actuates the switching mechanism (not shown) in chamber 365 to de-energize the pulling coil of the solenoid, leaving only its holding coil energized. Subsequently, upon de-energization of the solenoid holding coil, solenoid 320 is returned from the retraction condition illustrated in FIG. 11 to its initial unactuated condition as shown in FIG. 10. The return of plungers 337 and 366 is effected by their return springs 338 and 369, respectively.

The emergency manual actuation mechanism 340 of FIGS. 10–12 comprises an elongated non-magnetic retraction rod 341 that extends through a relatively short guide aperture 342 within terminal housing 326 and through an axial bore 370 in the switch actuation plunger 366. The inner end of retraction rod 341 is again provided with an enlarged shoulder 351 disposed within an axial socket 352 in the outer end of solenoid plunger 337. A bushing 356 mounted in the open end of socket 352 affords a shoulder in position to engage the retraction rod shoulder 351; in the normal, unactuated condition for mechanism 340 there is preferably a slight clearance 355 between shoulders 351 and 356.

An O-ring seal 371 is seated in encompassing relation to retraction rod 341 where the retraction rod emerges from switch housing 326 and is normally held in place by a retainer washer 372. The outer end of retraction rod 341 extends freely through a guide sleeve 374 of relatively large diameter that projects outwardly from switch housing 326 and may be molded integrally with the switch housing. A fixed cam member 375 is mounted upon sleeve 374 immediately adjacent housing 326. Cam member 375 is engaged by a rotary cam member 376 having an internal shoulder 377 and an end slot 378, slot 378 being provided for engagement by a screwdriver or other conventional manual driving tool. A stop sleeve 379 mounted on the outer end of retraction rod 341 engages the internal shoulder 377 of cam member 376.

The mating cam surfaces on the fixed cam member 375 and the rotary cam member 376 provide for axial displacement of cam member 376 by rotation of that cam member through an angle of 90°relative to the fixed cam member 375, as shown in FIG. 12. To actuate mechanism 340, a screwdriver or similar tool is inserted in slot 378, starting from the position shown in FIG. 10, and is employed to rotate cam member 376 ninety degrees to the position shown in FIG. 11. That is, referring to FIG. 12, rotation of cam member 376 through an angle of 90°from the position shown in solid lines drives the rotary cam member to the position shown by phantom outlines 376A. The axial movement of the rotary cam member 376 extends through a distance T, FIG. 12, that is equal to the normal travel T of the solenoid in normal electrical operation, FIG. 10. This axial movement of rotary cam member 376 drives retraction rod 341 from the position of FIG. 10 to the position shown in FIG. 11. In the course of that movement shoulder 351 on retraction rod 341 engages bushing 356 in solenoid plunger 337 and pulls the solenoid plunger to its actuation position as shown in FIG. 11.

To return mechanism 340 from the retraction condition illustrated in FIG. 11 to the normal condition illustrated in FIG. 10, it is a simple matter to again rotate cam member 376 through an angle of 90°, again utilizing an ordinary screwdriver inserted in slot 378. This rotational movement of cam member 376 permits the solenoid return spring 338 to drive plunger 337 back to its initial position as shown in FIG. 10. At the same time, spring 369 restores the switch actuation plunger 366 to its original position, so that solenoid 320 is again ready for normal electrical operation.

Figure 12A:
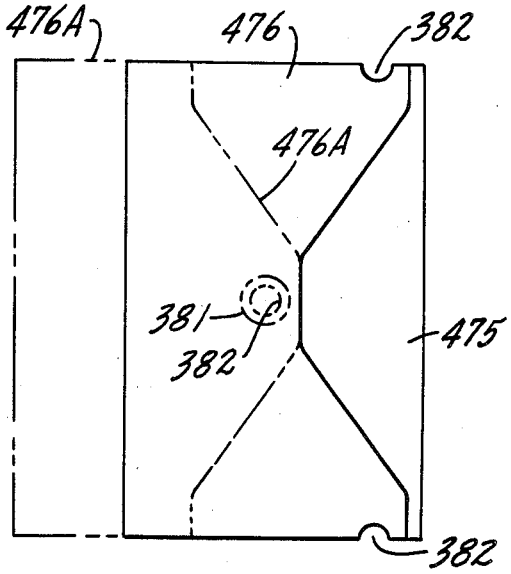
FIG. 12A is a diagrammatic displacement view of a modification of the cam elements of FIG. 12.

The interaction between cam members 375 and 376 is best visualized from the displacement diagram of FIG. 12. In the solid line portion of FIG. 12, the two cam members are shown in the normal, unactuated positions corresponding to FIG. 10. It can be seen that rotation of the rotary cam member 376 is effective to drive the rotary cam member to its alternate position 376A, displaced by distance T in the direction of arrow A, which corresponds to the direction of arrow A in FIG. 10. The end position 376A is thus achieved for cam member 376, this being the retraction position for the cam. A modified arrangement requiring rotation of 180° between a stationary cam member 475 and a rotary cam member 476 is shown in FIG. 12A.

When solenoid 320 is utilized in an engine or in another environment entailing substantial vibration, there may be a tendency for cam member 376 to rotate back from its retraction position (FIG. 11) to its normal position (FIG. 10), negating the desired operation for mechanism 340. To prevent this, a set screw 381 may be inserted through one of two apertures 382 in the rotary cam member 376 and engage one of two suitable threaded openings 383 in guide sleeve 374; see FIG. 11. Only one set screw 381 is utilized, but two apertures 382 may be provided in rotary cam member 376 because the rotary cam member might be turned 90° in either direction starting from the original alignment shown in FIG. 10. Although retainer set screw 381 is not required for the normal operating condition of mechanism 340, FIG. 10, provision may be made for storing set screw 381 for use when needed, as illustrated in FIG. 10. A similar retainer arrangement may be utilized for the modification of FIG. 12A.

FIGS. 13 and 14 illustrate an emergency manual actuation mechanism 540 applied to a solenoid 520 which, like the previously described solenoid 320, incorporates an internal switching mechanism for the pulling and holding coils of the solenoid. FIGS. 13 and 14 show only a part of solenoid 520, comprising a main cylindrical housing 521, a switch housing 526, a rear end plate 535 and associated attraction stud 536 for the magnetic circuit of the solenoid, a main plunger body 537, and a plunger return spring 538. Switch housing 526 is again preferably formed of a reinforced molded high temperature resin material affording an internal chamber 565 within which a conventional switching mechanism (not shown) is mounted. That switch mechanism is actuated by a plunger 566 which projects from chamber 565 through a central bore 549 in attraction stud 536, with the inner end of plunger 566 facing the main solenoid plunger 537. The switch actuation plunger 566 includes an integral shoulder 568 employed to actuate the switching mechanisms in chamber 565. A return spring 569 is provided for plunger 566.

Solenoid 520 is the same in its operation as previously described solenoid 320 (FIGS. 10 and 11). Thus, to actuate solenoid 520 its pulling and holding coils are both energized through the switch mechanism in housing 526, pulling plunger 537 to the retracted position illustrated in FIG. 14. In the course of this movement plunger 537 drives the switch actuation plunger 566 to the position shown in FIG. 14 and shoulder 568 actuates the switching mechanism (not shown) in chamber 565 to de-energize the pulling coil of the solenoid. When the solenoid holding coil is de-energized at a later time the mechanism returns to the normal condition illustrated in FIG. 13 by operation of return springs 538 and 569.

The emergency manual actuation mechanism 540 of FIGS. 13 and 14 includes an elongated non-magnetic retraction rod 541, preferably of molded high temperature resin, having a construction corresponding to that of the retraction rod shown in FIGS. 10 and 11. Thus, retraction rod 541 extends through an axial bore 570 in plunger 566; the inner end of rod 541 has an enlarged shoulder 551 located within an axial socket 552 in plunger 537 in position to engage a bushing 556. In its normal unactuated position the head 551 of rod 541 has a slight clearance 555 with respect to bushing 556.

At its outer end rod 541 extends through an O-ring seal 571 held in place by a retainer washer 572. The outer end of rod 541 extends freely through a sleeve 574 projecting outwardly from switch housing 526 and preferably molded integrally with the switch housing. Sleeve 574 is formed with a male thread 575 having a length T corresponding to the displacement distance T for the main solenoid plunger 337.

A cylindrical cup-shaped actuation member 576, preferably of molded high temperature resin material, is incorporated in mechanism 540. Member 576 includes a female threaded portion 580 engaging the male thread portion 575 on guide sleeve 574. Actuation member 576 also includes an internal shoulder 577 engaged by a stop sleeve 579 mounted on the outer end of actuation rod 541. Actuation member 576 may be provided with an end slot 578 for engagement by a screwdriver or other conventional manual driving tool. Alternatively or additionally, the outer portion of actuation member 576 may be shaped to receive a conventional wrench.

To actuate mechanism 540 from the normal condition illustrated in FIG. 13 to the retracted condition shown in FIG. 14, a screwdriver or wrench is applied to actuation member 576 and is used to rotate that member so that the mating threads 575 and 580 drive the actuation member in the direction indicated in FIG. 13 by arrow A. Direct manual actuation may also be adequate. With continued rotation of actuation member 576, rod 541 is moved to the left (arrow A), initially closing the small gap 555 so that shoulder 551 engages bushing 556 to effect a mechanical connection between rod 541 and solenoid plunger 537. Continued rotation of member 576 continues the movement of rod 541, pulling plunger 537 toward attraction stud 536. The rotary motion of member 576 is continued until the mechanism reaches the full retracted condition shown in FIG. 14. At this point, the female thread 580 within actuation member 576 has moved to a point clear of the male thread 575 on sleeve 574. Consequently, once the full retracted position is reached continued rotation of member 576 does not exert any further thrust on retraction rod 541 in the direction of arrow A so that excess rotation cannot damage mechanism 540. At this stage, threads 575 and 580 function as a retainer means, retaining rod 341 and plunger 337 in their retraction positions.

To return mechanism 540 from the retraction position of FIG. 14 to the normal condition of FIG. 13, actuation member 576 is again rotated but in the opposite direction. Threads 575 and 580 are again engaged and rotation of member 576 is continued until it again reaches the position shown in FIG. 13. The return movement of actuation member 576 allows springs 538 and 569 to return the main solenoid plunger 537 and the switch actuation plunger 566 to their original positions so that solenoid 520 is again ready for normal electrical operation.

All of the described embodiments of the invention are simple and economical in construction yet reliable in their operation when an emergency condition prevents normal operation of the solenoid. No special tools are required to operate any of these manual actuation mechanisms; an ordinary screwdriver or wrench is the most that is needed. Though only mechanisms 340 and 540 are shown in self-switching solenoids, it will be apparent that the other mechanisms 40, 140 and 240 may be readily adapted to use in solenoids that incorporate coil switching. Conversely, it will be apparent that the manual actuation mechanisms 340 and 540 can be used with switchless solenoids. Mechanisms 40, 140, and 540 are particularly advantageous because the mechanical advantage afforded by the threads in each of these devices greatly facilitates retraction of the solenoid plunger against the bias of a strong solenoid return spring. A similar mechanical advantage is realized through the cams in mechanism 340.

We claim:

1. In a solenoid of the kind comprising an elongated housing, a magnetic plunger disposed within the housing and axially movable between an initial position and an actuation position, one end of the plunger being accessible through one end of the housing for connection to an external apparatus, spring means biasing the plunger toward its initial position, and solenoid coil means for driving the plunger to its actuation position, an emergency manual actuation mechanism comprising:

a retraction rod axially movably mounted in the other end of the solenoid housing in alignment with the plunger, the retraction rod having a normal position in which the retraction rod is effectively disengaged from the plunger and does not interfere with or react to plunger movement;

connecting means for interconnecting the retraction rod and the solenoid plunger;

means for moving the retraction rod from its normal position through an intermediate position to a retraction position, such movement of the retraction rod to its intermediate position engaging the connecting means and such further movement of the retraction rod to its retraction position driving the plunger from its initial position to its actuation position;

and retainer means for retaining the retraction rod and the plunger in their respective retraction and actuation positions.

2. An emergency manual actuation mechanism for a solenoid, according to claim 1, in which the movement of the retraction rod between its intermediate and retraction positions comprises rotary movement.

3. An emergency manual actuation mechanism for a solenoid, according to claim 2 in which:

the connecting means comprises a thread on the inner end of the retraction rod and a mating threaded socket in the end of the plunger facing the rod;

and the direction of movement of the retraction rod from its normal position to its intermediate position is axially inward of the housing into contact with the plunger followed by rotary movement of the rod to engage the threaded inner end of the rod in the plunger socket.

4. An emergency manual actuation mechanism for a solenoid, according to claim 3, and further comprising resilient bias means biasing the retraction rod away from the plunger toward its normal position.

5. An emergency manual actuation mechanism for a solenoid, according to claim 3, in which the retainer means comprises mating shoulders on the retraction rod and the solenoid housing limiting inward movement of the retraction rod, and the threaded socket in the plunger has a depth sufficient to pull the plunger to its actuation position by continued rotary movement of the retraction rod subsequent to engagement of the connecting means.

6. An emergency manual actuation mechanism for a solenoid, according to claim 5, in which:

the retraction rod is disposed entirely within the solenoid housing;

the solenoid housing includes an access opening affording access to the end of the retraction rod opposite the plunger; and the retraction rod moving means comprises a head on the end of the retraction rod facing the access opening, slotted to receive a conventional manual driving tool.

7. An emergency manual actuation mechanism for a solenoid, according to claim 6, and further comprising an O-ring fluid seal between the retraction rod head and the solenoid housing.

8. An emergency manual actuation mechanism for a solenoid, according to claim 7, and further comprising resilient bias means biasing the retraction rod away from the plunger toward its normal position.

9. An emergency manual actuation mechanism according to claim 3, for a solenoid further comprising a magnetic attraction stud engaged by the solenoid plunger when the plunger is in its actuation position, in which:

the retraction rod extends through an axial bore in the magnetic attraction stud;

and the retraction rod is of non-magnetic material.

10. An emergency manual actuation mechanism for a solenoid, according to claim 9, further comprising an annular guide bushing, seated against the outer end of the attraction stud, encompassing the retraction rod and centering that rod in relation to the axial bore in the attraction stud.

11. An emergency manual actuation mechanism for a solenoid, according to claim 10, in which the retraction rod and the guide bushing are both of molded resin material.

12. An emergency manual actuation mechanism for a solenoid, according to claim 11 in which the retraction rod and the guide bushing are both of molded glass-filled nylon.

13. An emergency manual actuation mechanism for a solenoid, according to claim 11, in which the retainer means comprises mating shoulders on the retraction rod and the solenoid housing limiting inward movement of the retraction rod, and the threaded socket in the plunger has a depth sufficient to pull the plunger to its actuation position by continued rotary movement of the retraction rod subsequent to engagement of the connecting means.

14. An emergency manual actuation mechanism for a solenoid, according to claim 1, in which the movement of the retraction rod from its intermediate position to its retraction position is a linear axial movement followed by a rotary movement.

15. An emergency manual actuation mechanism for a solenoid, according to claim 14, in which:

one end of the retraction rod projects out of the solenoid housing and the other, inner end of the retraction rod extends into a central axial bore in the plunger;

the connecting means comprises a shoulder on the inner end of the retraction rod engageable with a radially inwardly extending flange on the plunger at the outer end of its central bore;

and the direction of movement of the retraction rod from its normal position to its intermediate position and from its intermediate position to its retraction position is axially outward of the housing.

16. An emergency manual actuation mechanism for a solenoid, according to claim 15, in which:

the retraction rod moving means comprises a portion of the retraction rod projecting outwardly from the solenoid housing;

the retraction rod includes an externally threaded intermediate segment aligned with an internally threaded bore in the housing through which the retraction rod extends;

and movement of the retraction rod from its intermediate position to its retraction position is effected by rotation of the rod.

17. An emergency manual actuation mechanism for a solenoid, according to claim 16, and further comprising an O-ring fluid seal between the retraction rod and the solenoid housing, between the connection means and the threaded intermediate section of the retraction rod.

18. An emergency manual actuation mechanism according to claim 16, a solenoid further comprising a magnetic attraction stud engaged by the solenoid plunger when the plunger is in its actuation position, in which:

the retraction rod extends through an axial bore in the magnetic attraction stud;

and the retraction rod is of non-magnetic material.

19. An emergency manual actuation mechanism for a solenoid, according to claim 18, in which the retraction rod is of molded resin material.

20. An emergency manual actuation mechanism for a solenoid according to claim 19, in which:

the inner end of the retraction rod extends into a central axial bore in the plunger; and the connecting means comprises a shoulder on the inner end of the retraction rod engageable with a radially inwardly extending flange on the plunger at the outer end of its central bore.

21. An emergency manual actuation mechanism for a solenoid, according to claim 20, in which the retainer means comprises a mating pin and slot retainer interlocking the retraction rod to the housing by rotary movement of the retraction rod subsequent to axial movement to its retracted position.

22. An emergency manual actuation means for a solenoid, according to claim 21, and further comprising an O-ring seal between the retraction rod and the solenoid housing, intermediate the retainer means and the connection means.

23. An emergency manual actuation mechanism according to claim 21, for a solenoid further comprising a magnetic attraction stud engaged by the solenoid plunger when the plunger is in its actuation position, in which:

the retraction rod extends through an axial bore in the magnetic attraction stud;

and the retraction rod is of non-magnetic material.

24. An emergency manual actuation mechanism for a solenoid, according to claim 23, in which the retraction rod is of molded resin material.

25. An emergency manual actuation mechanism for a solenoid, according to claim 20, in which:

a rotary cam member is mounted on the outer end of the retraction rod;

a fixed cam member is mounted on the solenoid housing, in engagement with the first cam member; and the cam members have a configuration such that rotation of the rotary cam member through a given angle drives the retraction rod from its normal position to its retraction position.

26. An emergency manual actuation mechanism for a solenoid, according to claim 25, and further comprising an O-ring seal between the retraction rod and the solenoid housing, intermediate the cam members and the connection means.

27. An emergency manual actuation mechanism for a solenoid, according to claim 25, in which the retainer means comprises a retainer member interconnecting the rotary cam member and the solenoid housing.

28. An emergency manual actuation mechanism according to claim 25, for a solenoid further comprising a magnetic attraction stud engaged by the solenoid plunger when the plunger is in its actuation position, in which the retraction rod extends through an axial bore in the magnetic attraction stud.

29. An emergency manual actuation mechanism for a solenoid, according to claim 28, in which the retraction rod is of molded resin material.

30. An emergency manual acutation mechanism for a solenoid, according to claim 20 and further comprising:

a guide sleeve projecting outwardly of the solenoid housing in encompassing relation to a portion of the retraction rod, the guide sleeve including a male threaded portion;

a cylindrical actuation member including a female threaded portion engaging the male threaded portion of the guide sleeve;

and means mechanically coupling the actuation member to the outer end of the retraction rod whereby axial movement of the retraction rod between its normal and retraction positions is effected by rotation of the actuation member.

31. An emergency manual actuation mechanism for a solenoid, according to claim 30, in which the axial length of the male thread on the guide sleeve is approximately equal to the distance through which the solenoid plunger moves between its initial and actuation positions and in which the threaded portions of the actuation member and the guide sleeve disengage when the retraction rod reaches its retraction position.

32. An emergency manual actuation mechanism for a solenoid, according to claim 31, in which the outer end of the actuation member has a configuration adapted for engagement by a conventional manual driving tool.

33. An emergency manual actuation mechanism for a solenoid according to claim 31, in which the guide sleeve is an integral unitary portion of an electrical housing comprising a part of the solenoid housing and in which the electrical housing and the actuation member are both formed of molded high temperature resin material.

34. An emergency manual actuation mechanism according to claim 33, for a solenoid further comprising a magnetic attraction stud engaged by the solenoid plunger when the plunger is in its actuation position, in which the retraction rod extends through an axial bore in the magnetic attraction stud.

35. An emergency manual actuation mechanism for a solenoid, according to claim 34, in which the retraction rod is of molded resin material.

36. An emergency manual actuation mechanism for a solenoid, according to claim 31, and further comprising an O-ring fluid seal between the retraction rod and the electrical housing.

37. In a solenoid of the kind comprising an elongated housing, a magnetic plunger disposed within the housing and axially movable between an initial position and an actuation position, one end of the plunger being accessible through one end of the housing for connection to an external apparatus, spring means biasing the plunger toward its initial position, and solenoid coil means for driving the plunger to its actuation position, an emergency manual actuation mechanism comprising:

a retraction rod axially movably mounted in the other end of the solenoid housing in alignment with the plunger, the retraction rod having a normal position in which the retraction rod is effectively disengaged from the plunger and does not interfere with or react to plunger movement;

connecting means for interconnecting the retraction rod and the solenoid plunger;

means for moving the retraction rod in a direction axially outward of the solenoid housing from its normal position to a retraction position, a first minor movement of the retraction rod engaging the connecting means and further movement of the retraction rod toward its retraction position driving the plunger from its initial position to its actuation position;

and retainer means for retaining the retraction rod and the plunger in their respective retraction and actuation positions.

* * * * *

UNITED STATES PATENT AND TRADEMARK OFFICE

CERTIFICATE OF CORRECTION

PATENT NO. : 4,679,017

DATED : July 7, 1987

INVENTOR(S) : Ralph E. Mishler and Peter J. Stocco

It is certified that error appears in the above—identified patent and that said Letters Patent is hereby corrected as shown below:

Column 13, line 43, cancel "19" and substitute --37--.

Signed and Sealed this

Thirteenth Day of September, 1988

*Attest:*

DONALD J. QUIGG

*Attesting Officer*

*Commissioner of Patents and Trademarks*